US008210311B1

(12) United States Patent
Rice

(10) Patent No.: US 8,210,311 B1
(45) Date of Patent: Jul. 3, 2012

(54) FIRE ESCAPE SYSTEM

(76) Inventor: Jimmy Rice, Provo, UT (US)

( * ) Notice: Subject to any disclaimer, the term of this patent is extended or adjusted under 35 U.S.C. 154(b) by 468 days.

(21) Appl. No.: 12/534,134

(22) Filed: Aug. 2, 2009

(51) Int. Cl.
*A62B 1/02* (2006.01)

(52) U.S. Cl. ..... 182/9; 182/5; 182/100; 182/189; 182/190; 182/191; 182/192; 182/193; 187/239; 187/240; 187/249

(58) Field of Classification Search ..... 182/5, 9, 182/133, 136, 100, 189, 190, 191, 192, 193; 187/239, 240, 241, 249, 401, 410
See application file for complete search history.

(56) References Cited

U.S. PATENT DOCUMENTS

| | | | | | |
|---|---|---|---|---|---|
| 2,654,638 | A * | 10/1953 | Elliott | 182/133 |
| 2,957,582 | A * | 10/1960 | Lusk | 211/1.57 |
| 3,428,145 | A * | 2/1969 | Lyon | 182/103 |
| 3,520,383 | A * | 7/1970 | Loock | 182/133 |
| 3,715,011 | A * | 2/1973 | Prather | 182/100 |
| 3,752,263 | A * | 8/1973 | Thevenot | 182/148 |
| 4,008,785 | A * | 2/1977 | Mugnaini | 182/133 |
| 4,121,689 | A * | 10/1978 | Bonvin | 182/3 |
| 4,301,891 | A * | 11/1981 | Harbian | 182/135 |
| 4,350,224 | A * | 9/1982 | Jochum et al. | 182/82 |
| 4,406,349 | A * | 9/1983 | Vilchek | 182/7 |
| 4,512,440 | A * | 4/1985 | Bixby | 182/146 |
| 4,520,895 | A * | 6/1985 | Armstrong | 182/3 |
| 4,629,032 | A * | 12/1986 | Armstrong | 182/9 |
| 4,781,269 | A * | 11/1988 | Clay | 182/5 |
| 4,887,694 | A * | 12/1989 | Ho | 182/82 |
| 4,928,791 | A * | 5/1990 | Hong | 182/135 |
| 5,056,619 | A * | 10/1991 | Darnell et al. | 182/5 |
| 5,234,075 | A * | 8/1993 | Lowden | 182/135 |
| 6,817,443 | B1 * | 11/2004 | Metz | 182/82 |
| 6,830,126 | B2 * | 12/2004 | Godwin | 182/82 |
| 6,955,244 | B2 * | 10/2005 | Yerman | 182/142 |
| 7,281,607 | B1 * | 10/2007 | Kiraly | 182/82 |
| 7,383,922 | B1 * | 6/2008 | Richey et al. | 187/267 |
| 7,766,124 | B2 * | 8/2010 | Horn | 182/100 |

* cited by examiner

*Primary Examiner* — Alvin Chin Shue
*Assistant Examiner* — Colleen M Chavchavadze

(57) ABSTRACT

A fire escape system includes at least one guide post and an escape platform slidably carried by the at least one guide post and comprising a platform plate; a pair of handlebars pivotally carried by the platform plate; a pair of guide rollers carried by the pair of handlebars, respectively, and adapted to detachably engage the at least one guide post; and a pair of brake assemblies carried by the escape platform and adapted to engage the at least one guide post.

7 Claims, 10 Drawing Sheets

FIRE ESCAPE SYSTEM

FIELD OF THE INVENTION

The present disclosure relates to fire escapes for buildings. More particularly, the present disclosure relates to a fire escape system which enables rapid escape from a building during a fire or other emergency.

BACKGROUND OF THE INVENTION

High-rise office buildings, apartment buildings and the like are typically equipped with a fire escape which includes interior or exterior stairs that span the entire height of the building. In emergency situations, the stairs provide a means of egress for persons to escape the building unharmed. However, fire escape stairs may not enable persons to escape a building in emergency conditions in a sufficiently rapid manner to avoid harm. This may be particularly the case for the infirm and others who are physically unable to successfully and safely negotiate the stairs to the ground.

Accordingly, a fire escape system which enables rapid escape from a building during a fire or other emergency is needed.

SUMMARY OF THE INVENTION

The present disclosure is generally directed to a fire escape system. An illustrative embodiment of the fire escape system includes at least one guide post and an escape platform slidably carried by the at least one guide post and comprising a platform plate; a pair of handlebars pivotally carried by the platform plate; a pair of guide rollers carried by the pair of handlebars, respectively, and adapted to detachably engage the at least one guide post; and a pair of brake assemblies carried by the escape platform and adapted to engage the at least one guide post.

BRIEF DESCRIPTION OF THE DRAWINGS

The disclosure will now be made, by way of example, with reference to the accompanying drawings, in which.

DETAILED DESCRIPTION

Figure 1:
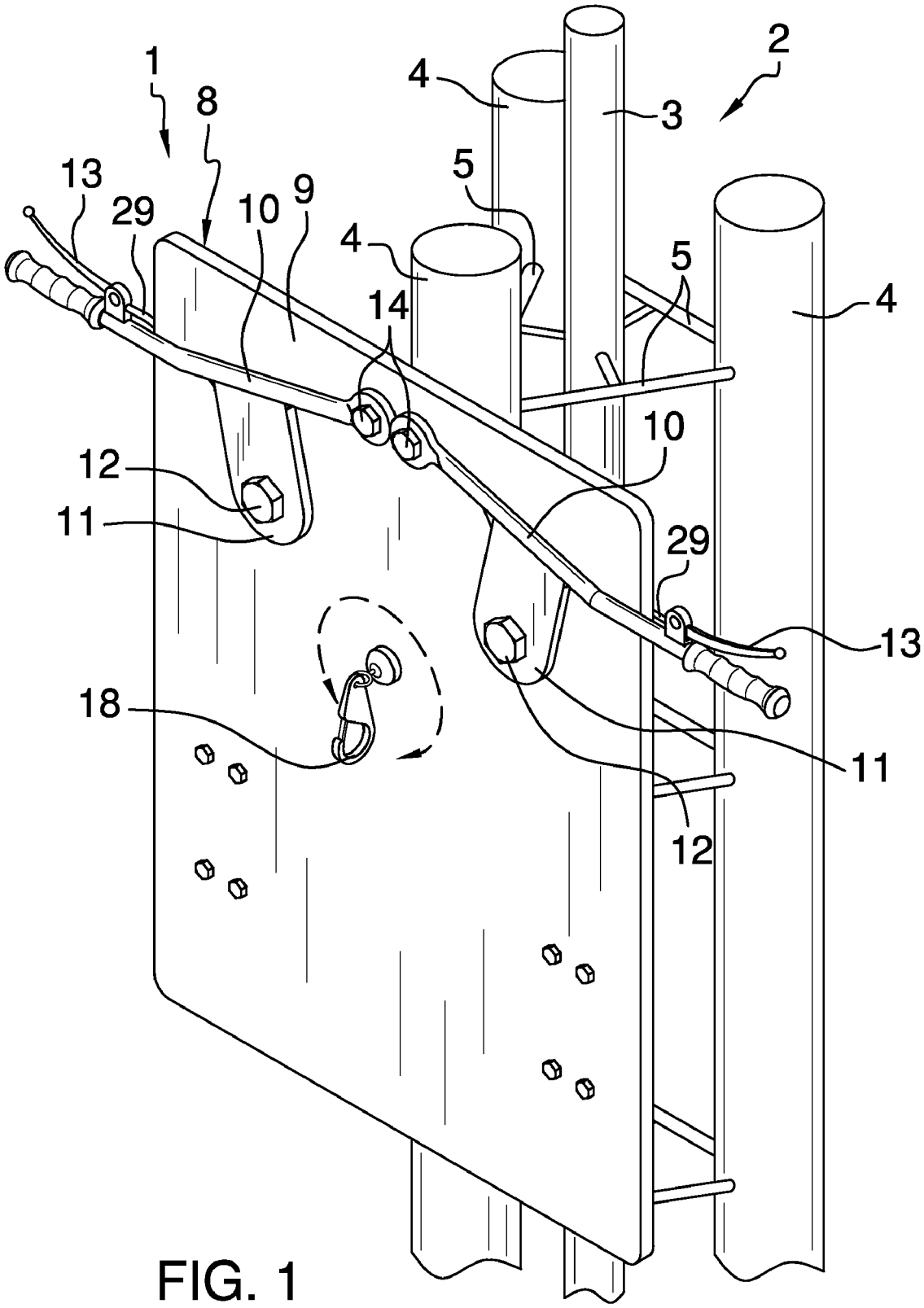
FIG. 1 is a front perspective view, partially in section, of an illustrative embodiment of the fire escape system.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure which is defined by the claims. Furthermore, there is no intention to be bound by any expressed or implied theory presented in the preceding technical field, background, brief summary or the following detailed description.

Referring initially to FIGS. 1-6 and 10, an illustrative embodiment of the fire escape system is generally indicated by reference numeral 1. The fire escape system 1 may include a guide post structure 2 having a guide post support 3. At least one guide post 4 may be attached to the guide post support 3 via guide post reinforcing members 5. In some embodiments, multiple guide posts 4 may be attached to the guide post support 3 in spaced-apart relationship with respect to each other.

An escape platform 8 is provided on each guide post 4 of the guide post structure 2. The escape platform 8 may include a platform plate 9 which may have a generally rectangular shape. A pair of handlebars 10 may be pivotally attached to the platform plate 9 via respective pivot bolts 14. Handlebar brackets 11 may extend from the respective handlebars 10. A brake lever 13 may be provided on each handlebar 10. A harness attachment hook 18 may be provided on the platform plate 9 of the escape platform 8 for purposes which will be hereinafter described. The harness attachment hook 18 may be swivelly attached to the platform plate 9.

Figure 2:
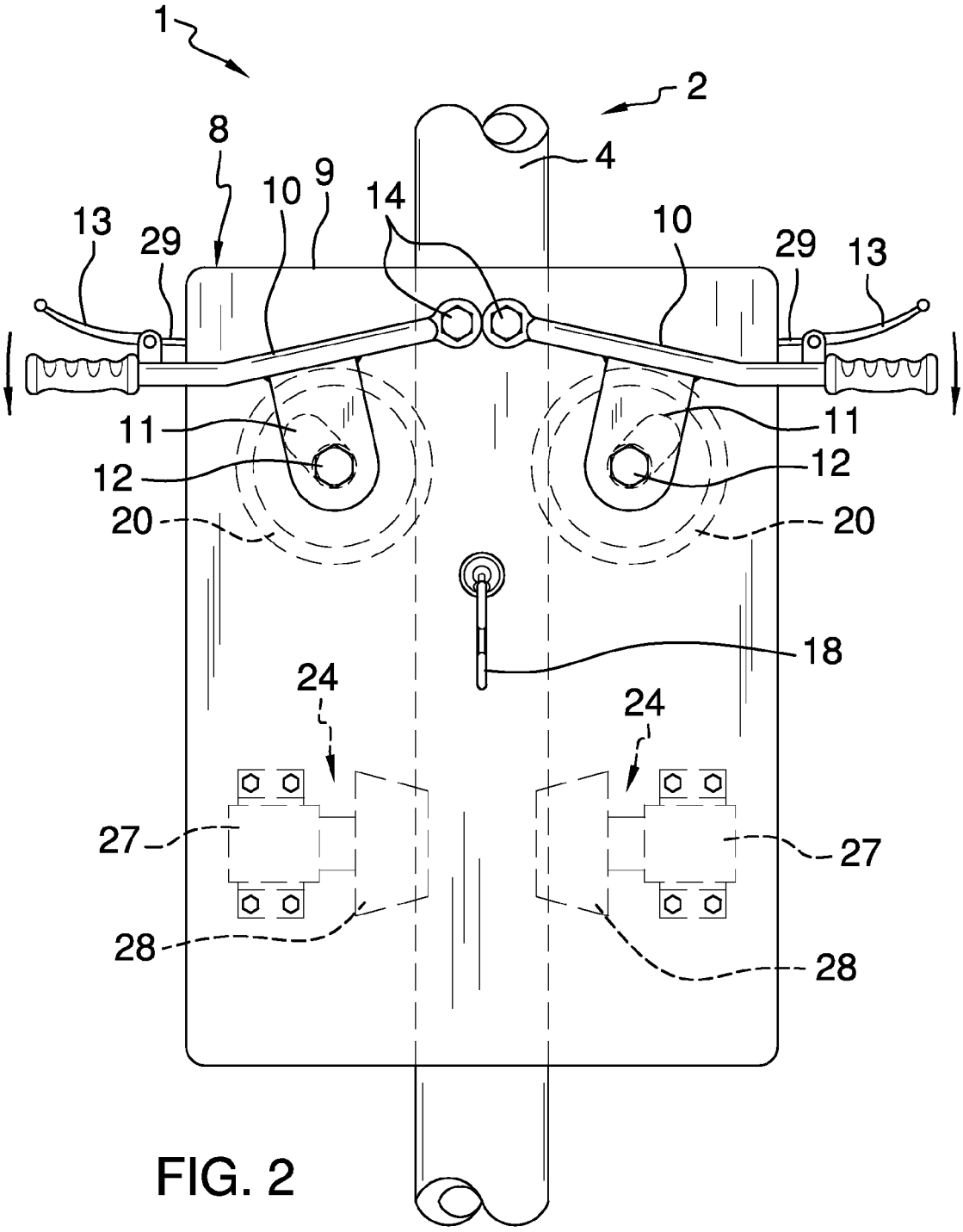
FIG. 2 is a front view, partially in section, of an illustrative embodiment of the fire escape system, with a pair of guide rollers (in phantom) and a pair of brake pads (in phantom) engaging a guide post of the system.
Figure 3:
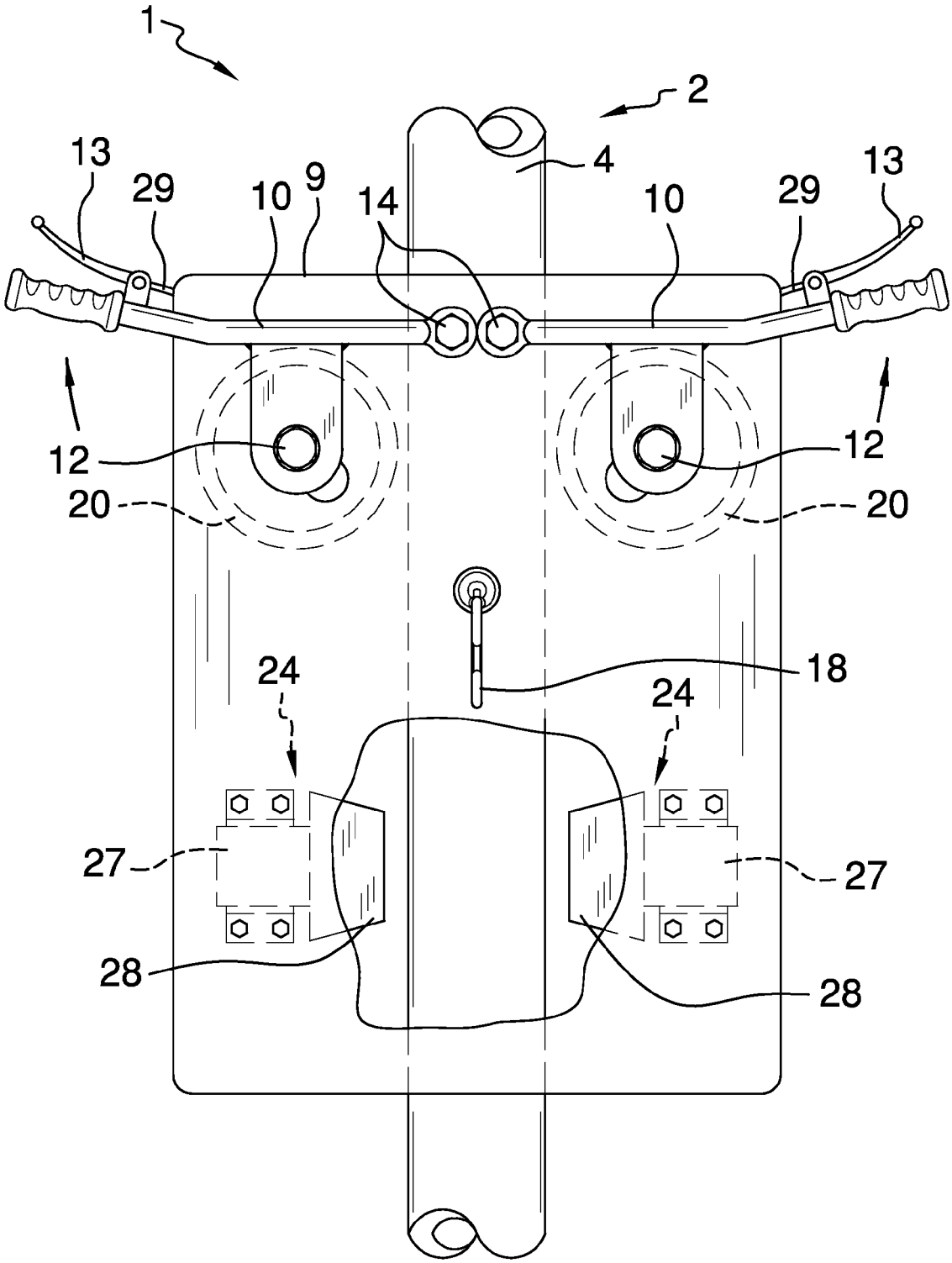
FIG. 3 is a front view, partially in section, of an illustrative embodiment of the fire escape system, with a pair of guide rollers (in phantom) and a pair of brake pads (in phantom) disengaging a guide post of the system.
Figure 4:
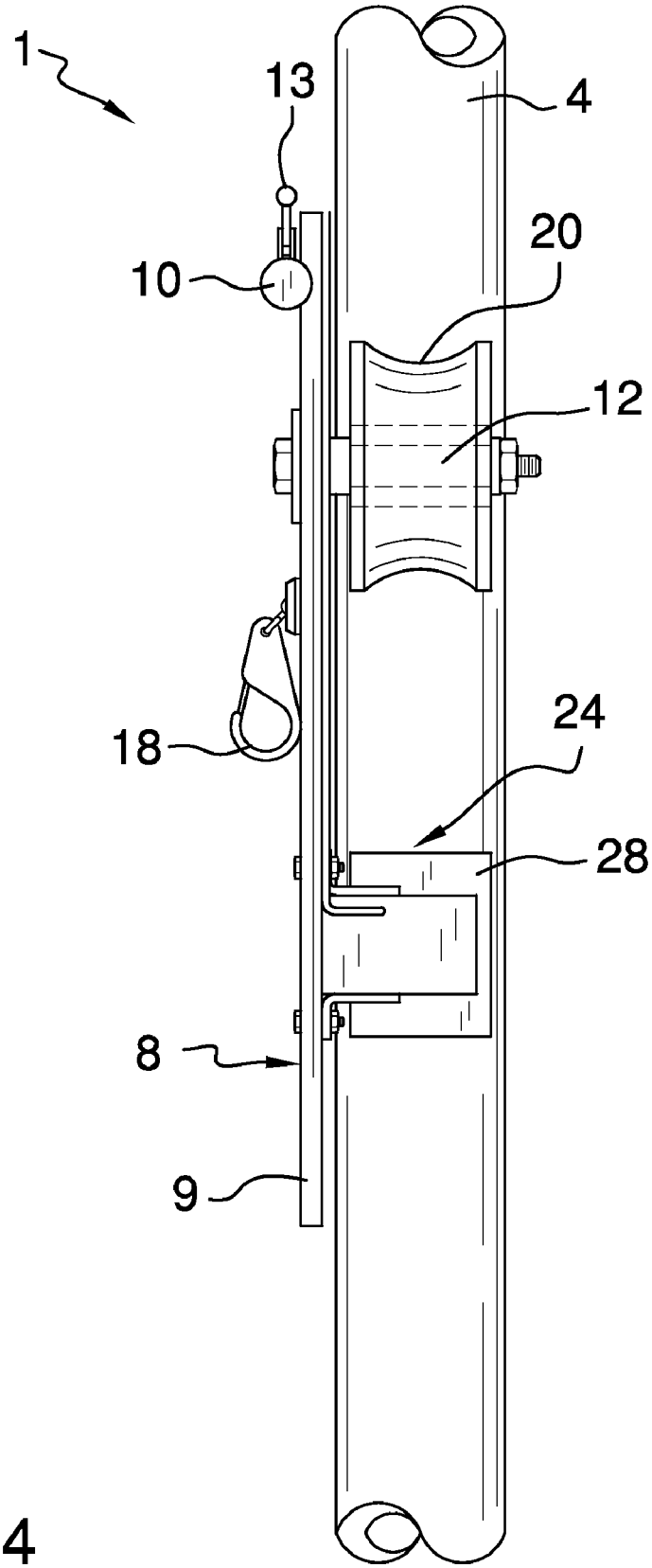
FIG. 4 is a side view, partially in section, of an illustrative embodiment of the fire escape system.

As shown in FIGS. 2 and 3, a guide roller 20 may be rotatably attached to the handlebar bracket 11 of each handlebar 10 via a bracket bolt 12 which extends through a bolt slot (not shown) provided in the platform plate 9. By pivoting of the handlebars 10 with respect to the respective pivot bolts 14, the guide rollers 20 may be adapted to detachably engage respective sides of the guide post 4, as shown in FIGS. 2 and 3.

Figure 5:
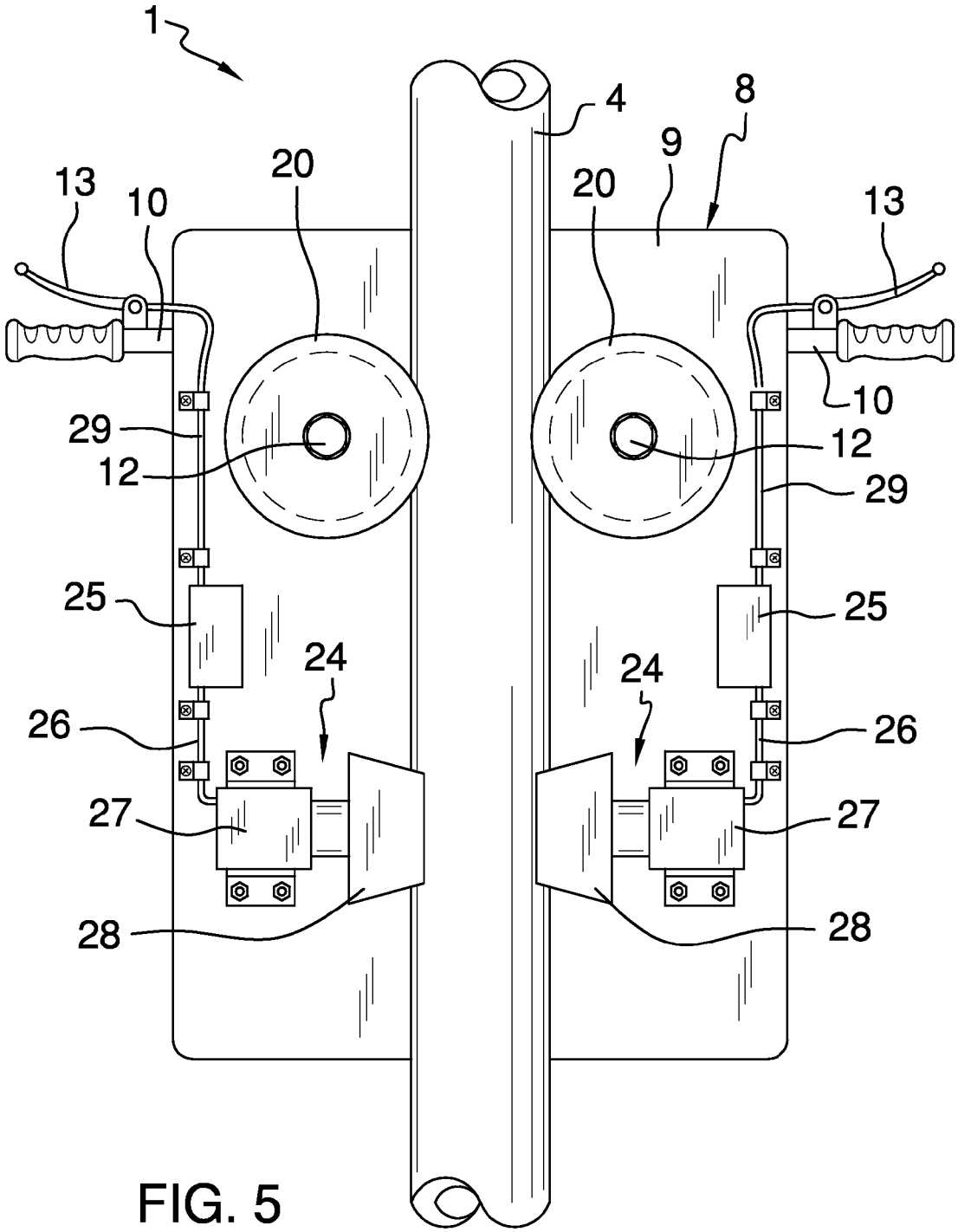
FIG. 5 is a rear view of an illustrative embodiment of the fire escape system, with the guide rollers and brake pads engaging the guide post.

As shown in FIG. 5, the brake levers 13 provided on the respective handlebars 10 may each engage a corresponding brake assembly 24. Each brake assembly 24 may include a hydraulic reservoir 25 which is provided on the platform plate 9. A solenoid brake 27 provided on the platform plate 9 may be connected to the hydraulic reservoir 25 via a hydraulic fluid line 26. The solenoid brake 27 may engage a brake pad 28 which is adapted to engage the guide post 4. Each brake lever 13 may be connected to the corresponding hydraulic reservoir 25 via a brake cable 29. Accordingly, actuation of each brake lever 13 facilitates flow of hydraulic fluid (not shown) from each hydraulic reservoir 25 to the corresponding solenoid brake 27 through the hydraulic fluid line 26. Consequently, each solenoid brake 27 presses the corresponding brake pad 28 against the guide post 24.

Figure 6:
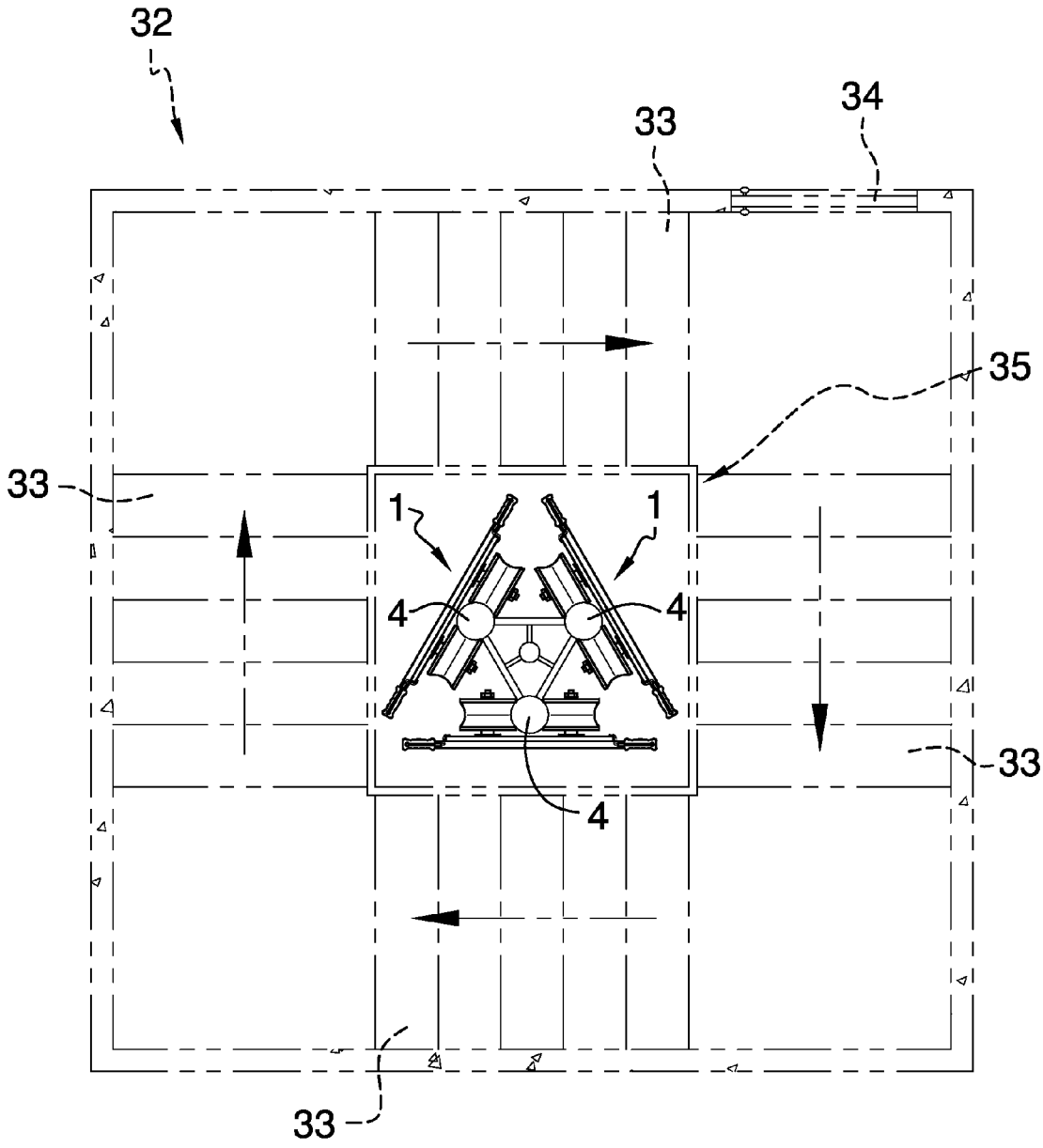
FIG. 6 is a top view in section of a building (in phantom), with a set of three fire escape systems provided in a central fire escape space of the building in an exemplary application of the fire escape system.

As shown in FIG. 6, in typical use multiple fire escape systems 1 may be provided on respective guide posts 4 of a guide post structure 2 which extends vertically through a central fire escape exit space 35 provided in a building 32 such as an apartment building or an office building, for example and without limitation. A stairwell 33 having one or multiple exterior exits 34 may surround the fire escape exit space 35. The fire escape space 35 may be accessible from the stairwell 33 at multiple locations via access openings (not shown). One or more escape platforms 8 may be positioned at each floor of the building 32.

Figure 10:
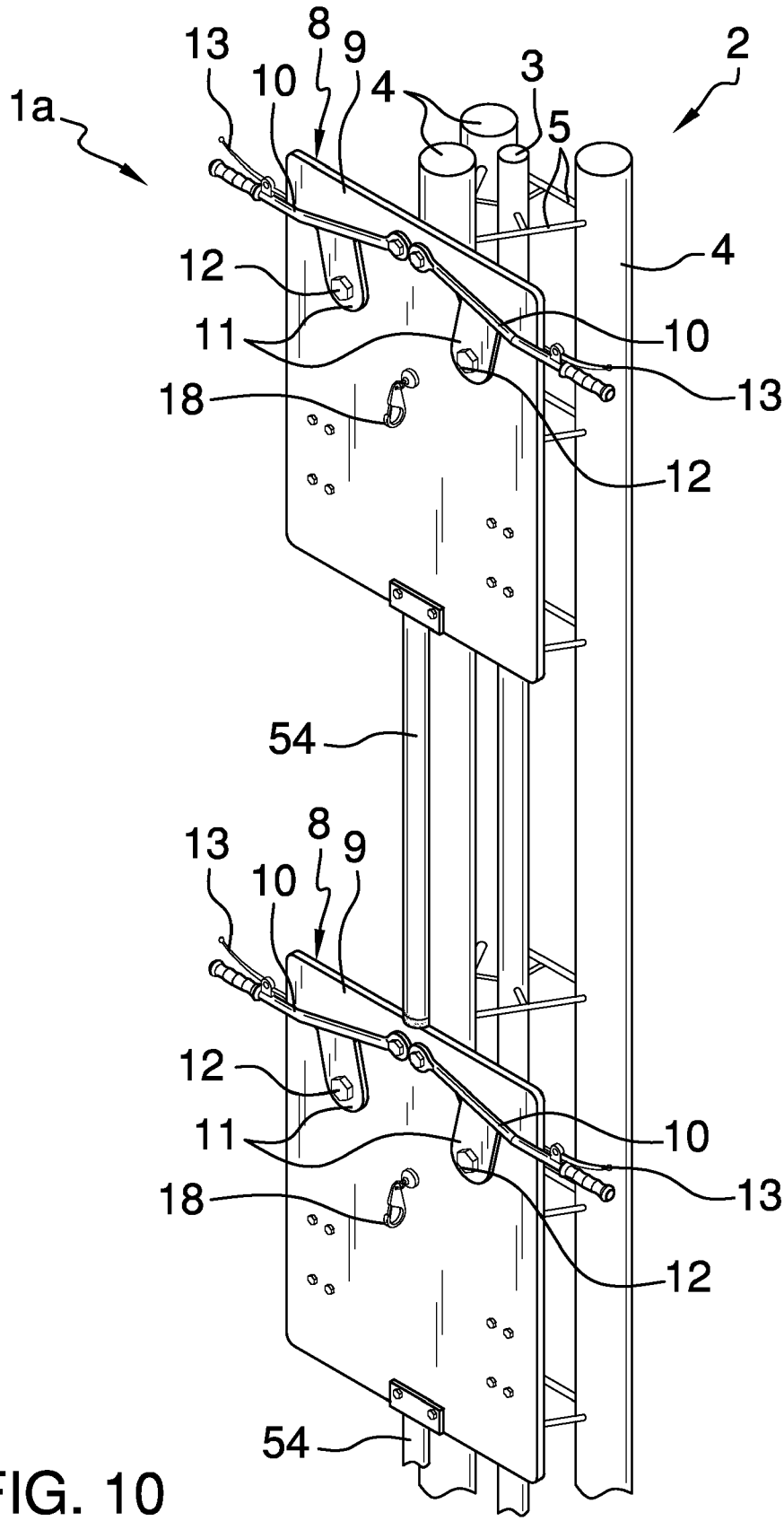
FIG. 10 is a perspective view, partially in section, of an illustrative embodiment of the fire escape system, with a detachable platform spacer connecting a pair of escape platforms of the system.

A harness (not shown) may be attached to the platform plate 9 of each escape platform 8 such as via the harness attachment hook 18. In emergency situations, a user (not shown) may access the fire escape space 35 from the stairwell 33 and fasten himself or herself in the harness (not shown). The user may grasp the handlebars 10 as the escape platform 8 travels downwardly on the guide post 4. The user may control the rate of descent of the escape platform 8 on the guide post 4 by causing engagement of the guide rollers 20 against the guide post 4, as shown in FIG. 5, via pivoting of the handlebars 10 with respect to the pivot bolts 14. The user may selectively stop descent of the escape platform 8 on the guide post 4 by engagement of the brake pads 28 of the respective brake assemblies 24 via application of the respective brake levers 13. When the user reaches the ground floor (not shown) of the building 32 inside the fire escape exit space 35, he or she may detach himself or herself from the harness and exit the building 32 through an exterior exit 34 in the stairwell 33 of the building 32. As shown in FIG. 10, in some applications a platform spacer 54 may connect adjacent escape platforms 8 on a common guide post 4 to each other to prevent collision of the escape platforms 8 with each other during descent of the escape platforms 8.

Figure 7:
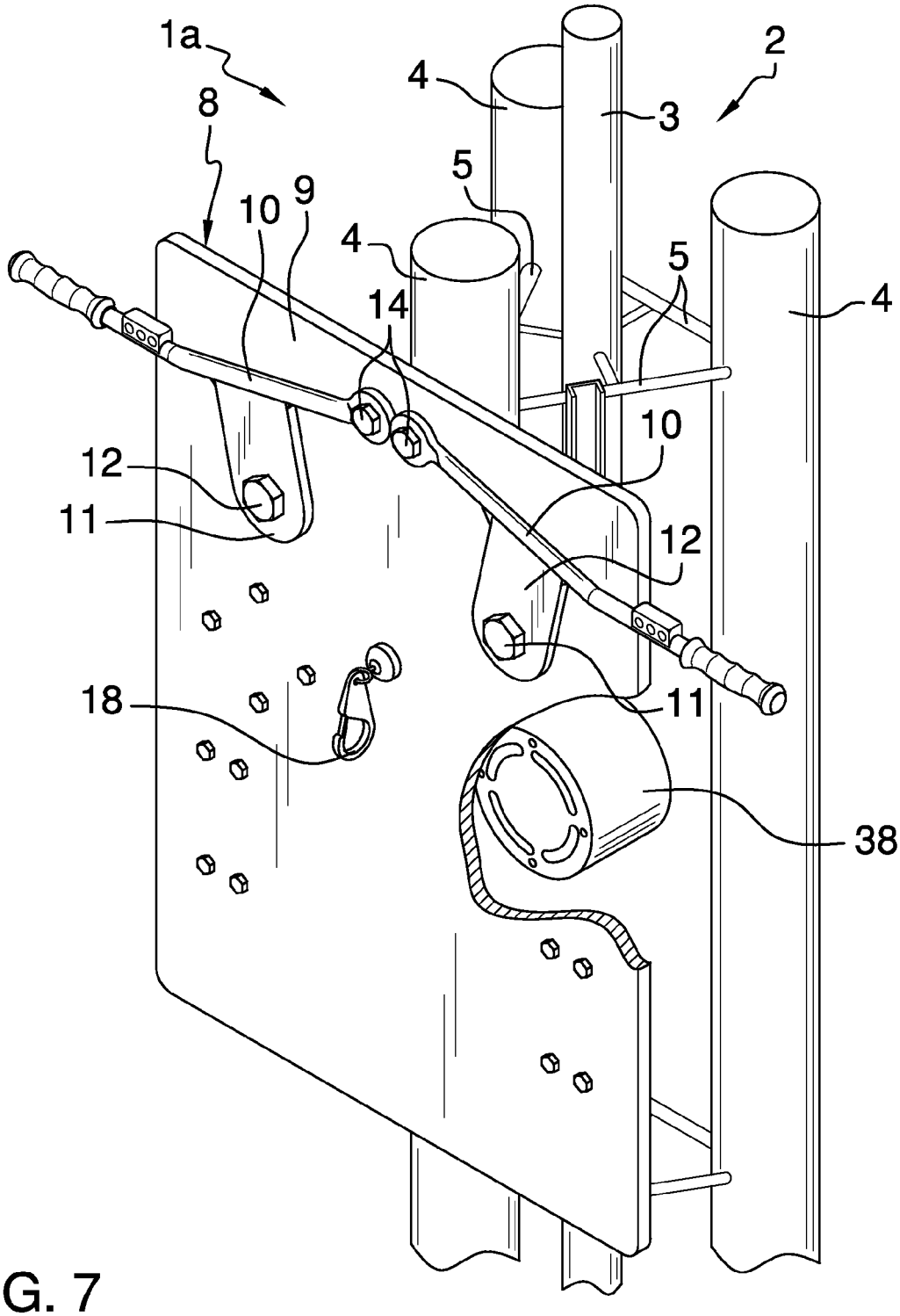
FIG. 7 is a front perspective view, partially in section, of an alternative illustrative embodiment of the fire escape system.
Figure 8:
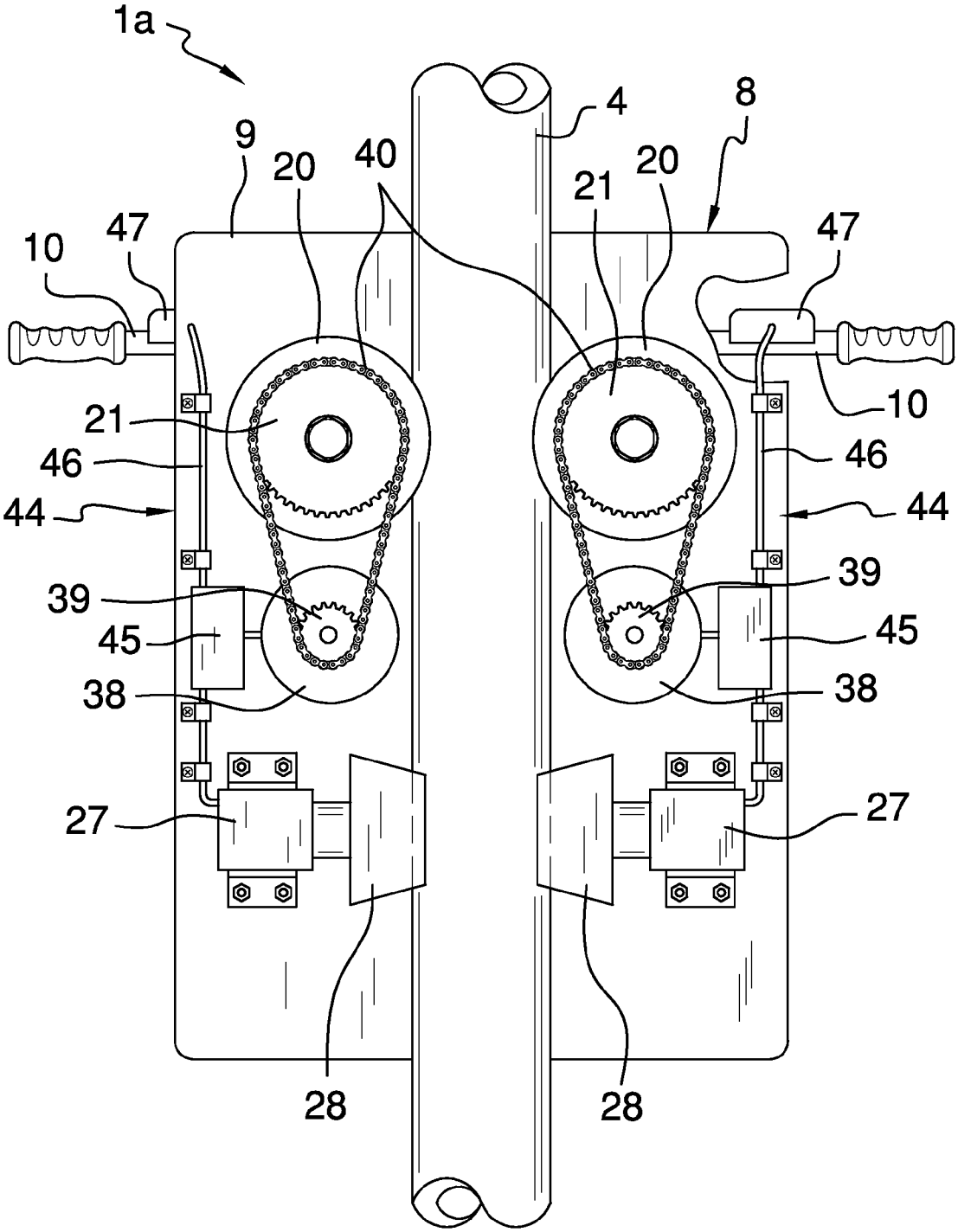
FIG. 8 is a rear view, partially in section, of the illustrative embodiment of the fire escape system illustrated in FIG. 7.
Figure 9:
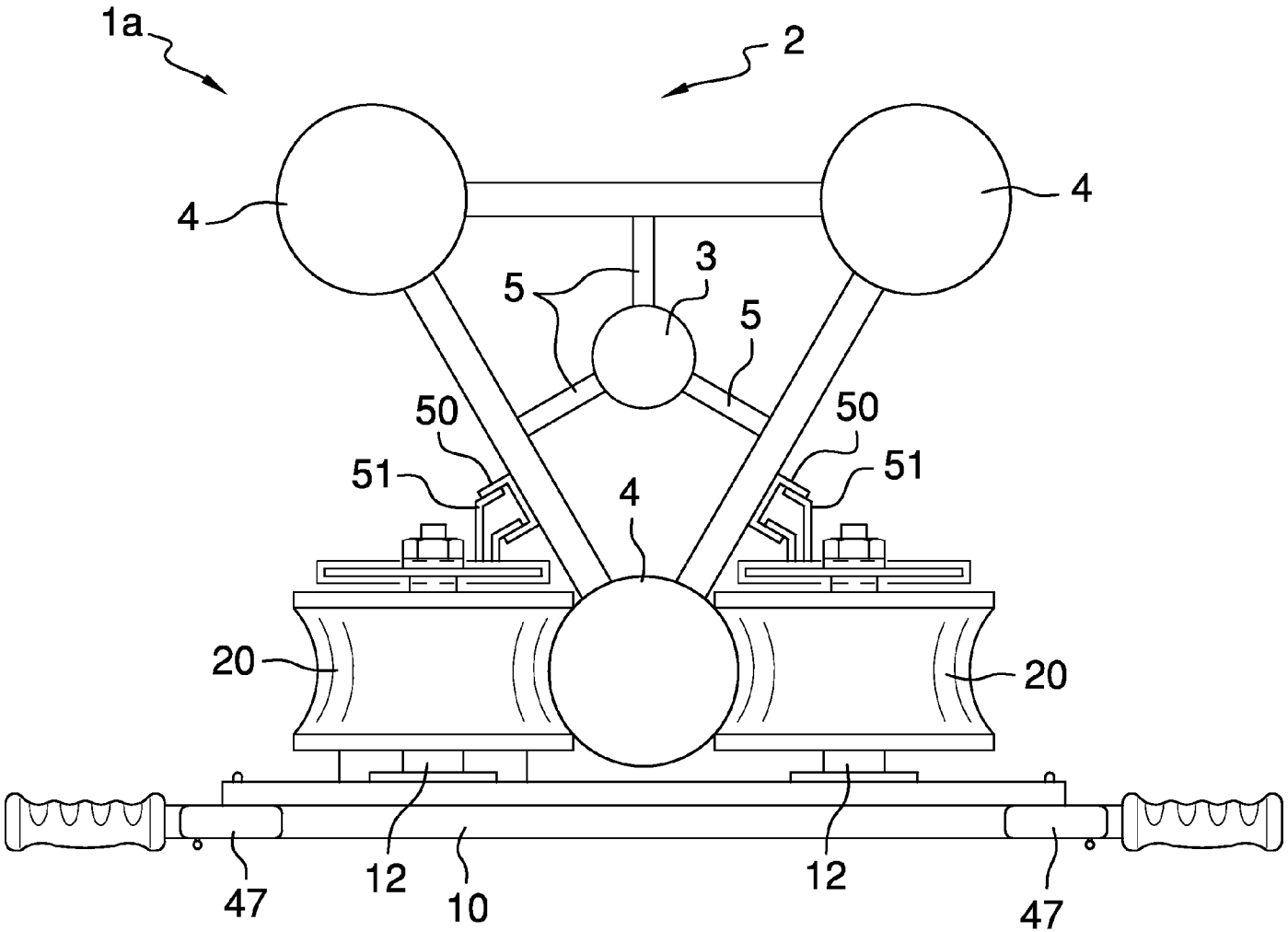
FIG. 9 is a top view of the illustrative embodiment of the fire escape system which is illustrated in FIG. 7.

Referring next to FIGS. 7-9 of the drawings, an alternative illustrative embodiment of the fire escape system is generally indicated by reference numeral 1*a*. In the fire escape system 1*a*, a pair of platform drive motors 38 may be provided on the platform plate 9 of each escape platform 8. As shown in FIG. 8, each platform drive motor 38 may drivingly engage a corresponding motor drive sprocket 39. A guide roller sprocket 21 may drivingly engage each guide roller 20. A drive chain 40 may engage the motor drive sprocket 39 and the guide roller sprocket 21. A control box 45 may be electrically connected to the corresponding solenoid brake 27 and to the corresponding platform drive motor 38. A user control interface 47 may be provided on each handlebar 10 and electrically connected to the corresponding control box 45 via control wiring 46. As shown in FIG. 9, a pair of motor power channels 50 may extend along each guide post structure 2. Each platform drive motor 38 may be electrically connected to the corresponding motor power channel 50 via a suitable power connection 51. Each motor power channel 50 and power connector 51 may be adapted to supply electrical power to each corresponding platform drive motor 38. Accordingly, each user control interface 47 may be operated to control rotation of each guide roller 20 via the corresponding platform drive motor 38 to facilitate selective upward travel of the escape platform 8 on the guide post support 3.

The brake assembly 44 of the fire escape system la may include the solenoid brake 27 which is connected to the control box 45 and the user control interface 47 which is connected to the control box 45. Accordingly, the user control interface 47 may be operated to control operation of the solenoid brakes 27 via the control box 45 to selectively terminate descent of the escape platform 8 on the guide post 4.

While the embodiments of the disclosure have been described above, it will be recognized and understood that various modifications can be made and the appended claims are intended to cover all such modifications which may fall within the spirit and scope of the disclosure.

What is claimed is:

1. A fire escape system, comprising:

at least one guide post; and an escape platform slidably carried by said at least one guide post and comprising:

a platform plate;

a pair of handlebars pivotally carried by said platform plate;

a pair of guide rollers carried by said pair of handlebars, respectively, and adapted to detachably engage said at least one guide post;

a pair of brake assemblies carried by said escape platform and adapted to engage said at least one guide post; and a pair of platform drive motors drivingly engaging said pair of guide rollers, respectively, of said escape platform.

2. The system of claim 1 further comprising a harness attachment hook carried by said platform plate of said escape platform.

3. The system of claim 1 further comprising a pair of user control interfaces carried by said pair of handlebars, respectively and operably connected to said pair of platform drive motors, respectively.

4. The system of claim 3 wherein said pair of brake assemblies comprises a pair of solenoid brakes connected to said pair of pair of user control interfaces, respectively, and a pair of brake pads engaged by said pair of solenoid brakes, respectively.

5. The system of claim 1 further comprising pair of motor drive sprockets drivingly engaged by said pair of platform drive motors, respectively; a pair of drive chains drivingly engaged by said pair of motor drive sprockets, respectively; and a pair of guide roller sprockets drivingly engaged by said pair of drive chains, respectively, and drivingly engaging said pair of guide rollers, respectively.

6. A fire escape system, comprising:

a guide post structure comprising a plurality of guide posts;

a plurality of escape platforms slidably carried by said plurality of guide posts, respectively, and each comprising:

a platform plate;

a harness attachment hook carried by said platform plate;

a pair of handlebars pivotally carried by said platform plate;

a pair of guide rollers carried by said pair of handlebars, respectively, and adapted to detachably engage said at least one guide post;

a pair of platform drive motors drivingly engaging said pair of guide rollers, respectively;

a pair of user control interfaces carried by said pair of handlebars, respectively and operably connected to said pair of platform drive motors, respectively; and a pair of brake assemblies comprising a pair of solenoid brakes carried by said escape platform and connected to said pair of user control interfaces, respectively, and a pair of brake pads engaged by said pair of solenoid brakes, respectively, and adapted to engage a corresponding one of said plurality of guide posts.

7. The system of claim 6 further comprising pair of motor drive sprockets drivingly engaged by said pair of platform drive motors, respectively; a pair of drive chains drivingly engaged by said pair of motor drive sprockets, respectively; and a pair of guide roller sprockets drivingly engaged by said pair of drive chains, respectively, and drivingly engaging said pair of guide rollers, respectively.

* * * * *